US005444734A

United States Patent [19]

Arthur et al.

[11] Patent Number: 5,444,734

[45] Date of Patent: Aug. 22, 1995

[54] DEVICE FOR LIFTING AND MOVING THE ROOF OF A SPRAY COOLED FURNACE

[75] Inventors: Mark T. Arthur, Lakewood; Frank H. Miner, Jr., North Olmsted, both of Ohio

[73] Assignee: UCAR Carbon Technology Corporation, Danbury, Conn.

[21] Appl. No.: 19,203

[22] Filed: Feb. 18, 1993

[51] Int. Cl.[6] ..... F27D 1/02

[52] U.S. Cl. ..... 373/73; 373/74; 110/331; 110/335

[58] Field of Search ..... 373/71, 73, 74, 52; 110/331, 332, 333, 334, 335

[56] References Cited

U.S. PATENT DOCUMENTS

| | | | |
|---|---|---|---|
| 4,644,558 | 2/1987 | Kerr | 373/74 |
| 4,715,042 | 12/1987 | Heggart et al. | 373/74 |
| 4,815,096 | 3/1989 | Burwell | 373/74 |
| 4,849,987 | 7/1989 | Miner, Jr. et al. | 373/74 |
| 5,115,184 | 5/1992 | Arthur et al. | 373/74 |

*Primary Examiner*—Bruce A. Reynolds
*Assistant Examiner*—Tu Hoang

[57] ABSTRACT

A combination of a spray cooled roof having a central opening, a support member and mast post wherein the roof is provided with an engagement which are detachably engaged to the corresponding engagement affixed to a support arm assembly which extends over a closed part of the roof. The support member is coupled to the mast post which raises, lowers and laterally moves the roof.

11 Claims, 9 Drawing Sheets

DEVICE FOR LIFTING AND MOVING THE ROOF OF A SPRAY COOLED FURNACE

BACKGROUND OF THE INVENTION

This invention relates to spray cooled furnace systems, e.g. electric arc furnace systems, and more particularly to an assembly for raising a hollow spray cooled roof of a furnace and moving the roof laterally to a position away from the furnace and back again:

Spray cooled electric furnace systems of the type disclosed in U.S. Pat. Nos. 4,715,042, 4,815,096 and 4,849,987 involve the spray cooling of furnace closure elements, e.g. removable furnace roofs, which are unitary, i.e. formed into one piece from steel plates, are hollow to contain spray elements, and typically have a generally frusto-conical shape with a central opening for furnace electrodes. The roof of the furnace is regularly raised, moved to the side of the furnace to permit charging and subsequently returned and lowered to enclose the furnace.

The systems currently used to raise, move and lower spray cooled roofs are typically massive and include the use of multiple hoist arrangements which are expensive and time consuming in operation and have horizontally extending support members which extend across the furnace roof close to the central opening and which are significantly exposed at their middle portions to heat from interior the furnace.

It is therefore an object of the present invention to provide an apparatus for raising and moving a spray cooled furnace roof which is relatively inexpensive and simple in design and operation and is minimally exposed to heat from interior the furnace.

SUMMARY OF THE INVENTION

A combination of a spray cooled roof having a central opening, a support member and mast post wherein the roof is provided with engagement means which are detachably engaged to corresponding engagement means affixed to a support arm assembly which extends only over a closed radial segment of the roof. The support member is coupled to the mast post which raises, lowers and laterally moves the roof.

DETAILED DESCRIPTION OF THE INVENTION

Figure 1:
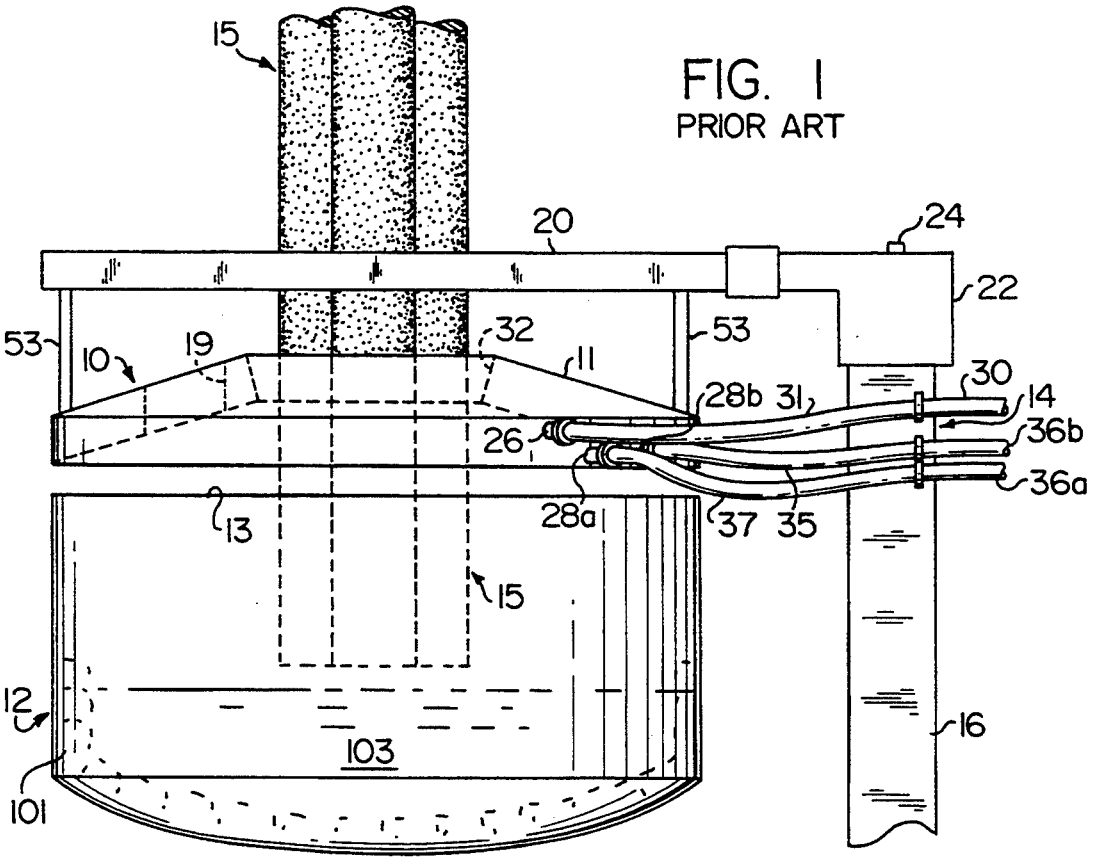
FIG. 1 PRIOR ART
FIG. 1 is a side elevational view of a typical electric furnace installation showing a furnace vessel, a furnace roof in a raised position over the furnace vessel and a prior art mast supporting structure for the roof.
Figure 2:
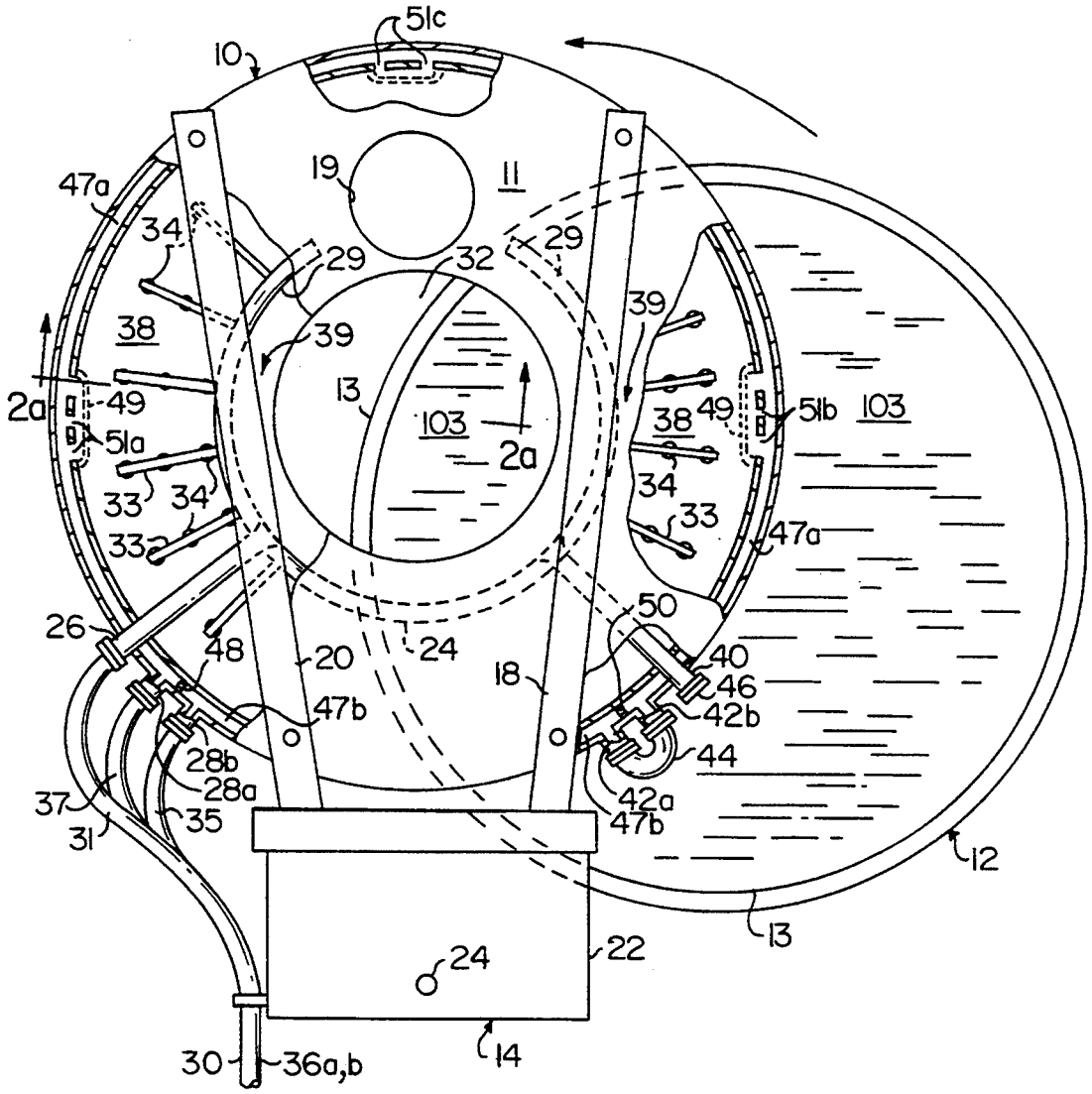
FIG. 2 PRIOR ART
FIG. 2 is a top plan view, partially cut away and partially in section, of the prior art spray cooled furnace roof of FIG. 1.
Figure 2A:
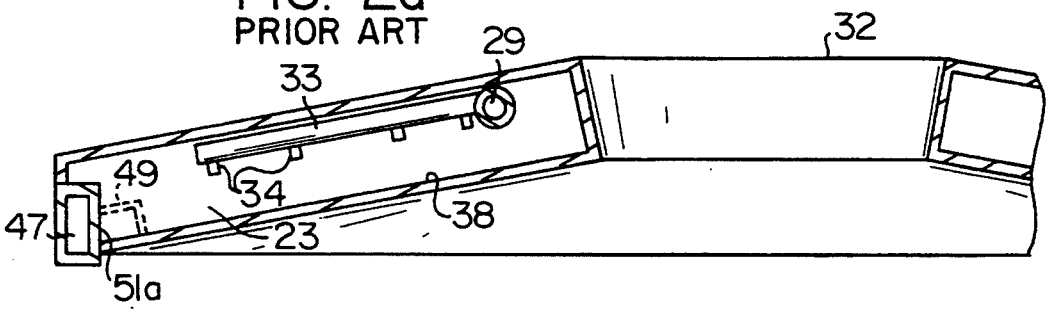
FIG. 2a PRIOR ART
FIG. 2*a* is a cross sectional view along the line 2*a*—2*a* of FIG. 2 also showing a partial elevation view of the furnace roof and, in phantom, a thermally stressed region and proposed cut-out portion of the furnace roof.
Figure 3:
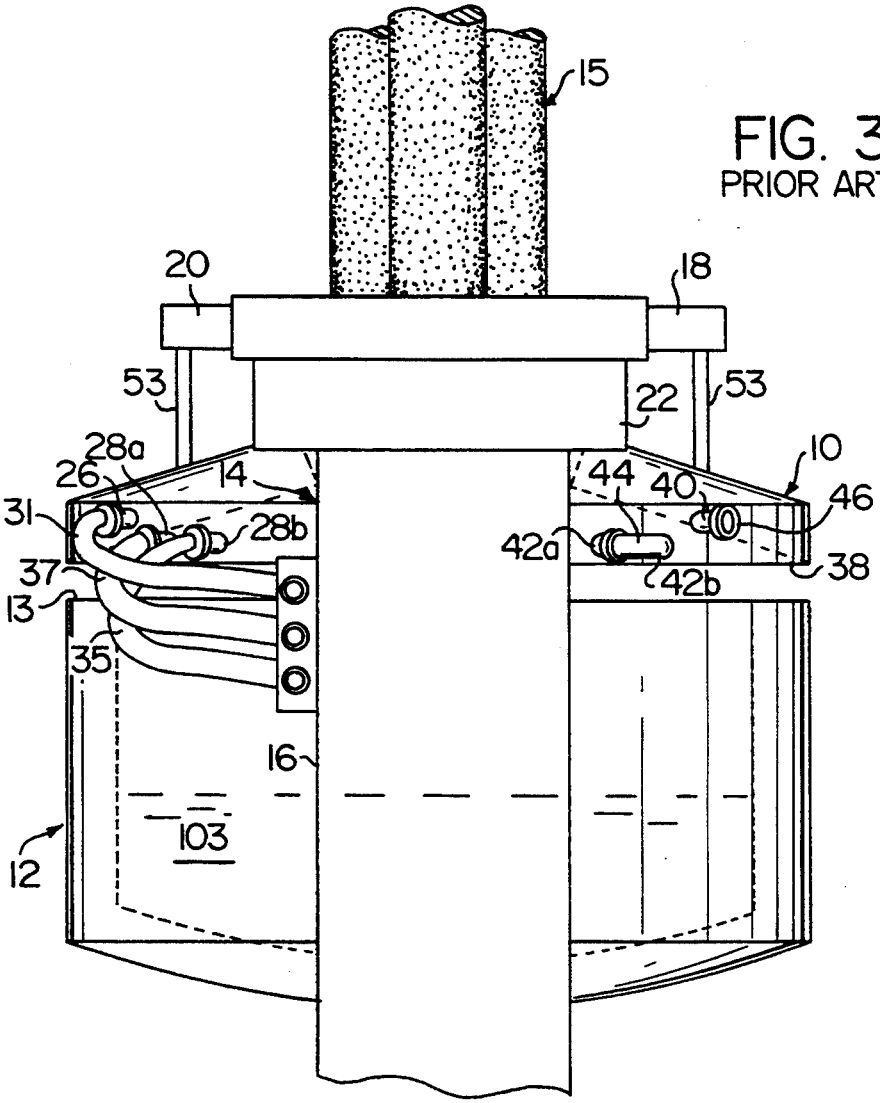
FIG. 3 PRIOR ART
FIG. 3 is a end elevational view, partly in section, of the electric furnace installation of FIG. 1 also showing the refractory lined molten metal-containing portion of the furnace vessel.

FIGS. 1–3 illustrate a spray cooled electric furnace installation as used for steel making, although the spray cooled furnace roof system can be utilized in any type of molten material processing vessel. FIGS. 1, 2 and 3 illustrate a spray cooled electric arc furnace installation of the type shown in U.S. Pat. No. 4,849,987—F. H. Miner and A. M. Siffer, in side, top and end views, respectively. FIG. 2*a* is an elevation view in cross-section of a portion of the spray-cooled roof. The circular water cooled furnace roof 10 is shown in FIGS. 1 and 3 being supported by a prior art furnace mast structure 14 in a slightly raised position directly over the rim 13 of electric arc furnace vessel 12. As shown in FIGS. 1 and 2*a*, the roof 10 is a unitary, integral i.e. one-piece, hollow closure component of frusto-conical shape which encloses spray cool elements 33, 34, 29, 49, and which is attached by chains, or other roof lift members 53 to a pair of horizontally extending mast arms 18 and 20 which extend almost completely over the top of the furnace 12 with their middle portions 39 close to furnace opening 32. As illustrated in FIG. 2, mast support 22 is able to pivot around point 24 on the upper portion of vertical mast post 16 to swing roof 10 horizontally to the side to expose the open top of furnace vessel 12 and molten metal 103 during charging the furnace, and at other appropriate times during or after furnace operation. During furnace operation as illustrated in FIG. 1, electrodes 15 extend into opening 32 from a position above roof 10 and are lowered through electrode ports of a delta or center piece in the central roof opening 32 into the furnace interior to provide the electric arc-generated heat to melt the charge. Exhaust port 19 permits removal of fumes generated from the furnace interior during operation.

The furnace system is mounted on trunnions or other means (not shown) to permit the vessel 12 to be tilted, after raising and horizontally moving the roof to pour off molten steel 103 into a conventional pouring vessel located to the side of the furnace.

The furnace roof system shown in FIGS. 1, 2 and 3 is set up to be used as a left-handed system whereby the mast 14 may pick up the unitary, one-piece roof 10 and swing it horizontally in a counterclockwise manner (as seen from above and illustrated in FIG. 2) clear of the furnace rim 13 to expose the furnace interior and molten metal 103. To prevent excessive heat buildup on the lower steel surface 38 of the hollow roof 10 as it is exposed to the interior of furnace vessel 12, a roof cooling system is incorporated and enclosed therein. The cooling system utilizes a fluid coolant such as water or some other suitable liquid to maintain the furnace roof at an acceptable temperature. The systems described in the aforementioned U.S. Pat. Nos. 4,715,042, 4,815,096 and 4,849,987, the disclosures of which are incorporated herein by reference are preferred, although other cooling systems can readily take advantage of the present invention. The enclosed cooling system comprises coolant inlet pipe 26 and outlet pipes 28*a* and 28*b* comprise the coolant connection means for the illustrated left-handed configured furnace roof system. An external circulation system (not shown) utilizes coolant supply pipe 30 and coolant drain pipes 36*a* and 36*b*, respectively, to supply coolant to and drain coolant from the coolant connection means of roof 10 as shown in FIGS. 1—3. The coolant circulation system normally comprises a coolant supply system and a coolant collection system, and may also include coolant recirculation means.

Attached to coolant supply pipe 30 is flexible coolant supply hose 31 which is attached by quick release coupling or other means to coolant inlet pipe 26 on the periphery of furnace roof 10. As shown in FIGS. 2 and 2*a*, inlet 26 leads to an inlet manifold 29 which extends around central delta opening 32 in the unpressurized hollow interior 23 of roof 10. Branching radially outward from manifold 29 in a spoke like pattern is a plurality of spray header pipes 33 to deliver the coolant to the various sections of the hollow roof interior 23. Protruding downward from various points on each header 33 is a plurality of spray nozzles 34 which direct coolant in a spray or fine droplet pattern to the upper side 50 of hollow roof lower panels 38, which slope gradually downwardly from center portion of the roof to the periphery. The cooling effect of the spray coolant on the steel surface 38 of roof 10 enables the temperature thereon to be maintained at a predetermined temperature range.

After being sprayed onto the roof lower panels 38, the spent coolant drains by gravity outwardly along the top of roof lower panels 38 and passes through drain inlets or openings 51*a*, 51*b* and 51*c* in a drain system. The drain system shown is a manifold which is made of rectangular cross section tubing or the like divided into segments 47*a* and 47*b*. As seen in FIG. 2, drain openings 51*a* and 51*b* are on opposite sides of the roof. The drain manifold takes the form of a closed channel extending around the interior of the roof periphery at or below the level of roof lower panels 38 and is separated by partitions or walls 48 and 50 into separate draining segments 47*a* and 47*b*. Drain manifold segment 47*a* connects drain openings 51*a*, 51*b* and 51*c* with coolant outlet pipe 28*a*. Drain manifold segment 47*b* is in full communication with segment 47*a* via connection means 44 and connects drain openings 51*a*, 51*b* and 51*c* with coolant outlet pipe 28*b*. Flexible coolant drain hose 37 connects outlet 28*a* to coolant drain pipe 36*a* while flexible coolant drain hose 35 connects outlet 28*b* and coolant drain pipe 36*b*. Quick release or other coupling means may be used to connect the hoses and pipes. The coolant collection means to which coolant drain pipes 36*a* and 36*b* are connected will preferably utilize jet or other pump means to quickly and efficiently drain the coolant from the roof 10. Any suitable other means to assist draining of the coolant from the roof or furnace shell may also be utilized.

Although they are not used as such during left-handed operation of the furnace roof system as shown in FIGS. 1, 2, and 3, a second coolant connection means which may be used in a right-handed installation of roof 10 is provided. This second or right-handed coolant connection means comprises coolant inlet 40 and coolant outlet 42. The left and right-handed coolant connection means are on opposite sides of roof 10 relative to a line passing through mast pivot point 24 and the center of the roof, and lie in adjacent quadrants of the roof. As with left-handed coolant inlet pipe 26, right-handed coolant inlet pipe 40 is connected to inlet manifold 29. As with the left-handed coolant outlet 28, right-handed coolant outlet 42 includes separate outlet pipes 42*a* and 42*b* which communicate with the separate segments 47*a* and 47*b* of the coolant drain manifold which are split by partition 50. To prevent coolant from escaping through the right-handed coolant connection means during installation of roof 10 in a left-handed system, the present invention also provides for capping means to seal the individual roof coolant inlets and outlets. A cap 46 may be secured over the opening to coolant inlet 40. A removable U-shaped conduit or pipe connector 44 connects and seals the separate coolant outlet openings 42*a* and 42*b* to prevent leakage from the roof and to provide for continuity of flow between drain manifold segments 47*a* and 47*b* around partition 50. Where the draining coolant is under suction, connector 44 also prevents atmospheric leakage into the drain manifold sections.

During operation of the furnace roof as installed in a left-handed furnace roof system shown in FIG. 2, coolant would enter from coolant circulation means through coolant pipe 30, through hose 31, and into coolant inlet 26 whereupon it would be distributed around the interior of the roof by inlet manifold 29. Coolant inlet 40, also connected to inlet manifold 29, is reserved for right-handed installation use and therefore would be sealed off by cap 46. After coolant is sprayed from nozzles 34 on spray headers 33 to cool the roof bottom 38, the coolant is collected and received through drain openings 51*a*, 51*b* and 51*c* into the drain manifold extending around the periphery of the roof 10 and exits through coolant outlet 28. As seen in FIG. 2, coolant draining through openings 51*a*, 51*b* and 51*c* on segment 47*a* of the drain manifold many exit the roof directly through coolant outlet 28*a*, through outlet hose 37 and into drain outlet pipe 36*a* before being recovered by the coolant collection means. Coolant draining through openings 51*a*, 51*b* and 51*c* on segment 47*a* of the drain manifold may also travel through coolant outlet 42*b*, through U-shaped connector 44, and back through coolant outlet 42*a* into manifold segment 47*b* in order to pass around partition 50. The coolant would then drain from drain manifold segment 47*b* through coolant outlet 28*b*, outlet hose 35 and through drain pipe 36*b* to the coolant collection means. Right-handed coolant outlet 42 is not utilized to directly drain coolant from the roof, but is made part of the draining circuit through the use of U-shaped connector 44. Upon being drained from the roof, the coolant may either be discharged elsewhere or may be recirculated back into the roof by the coolant system. Left-handed coolant connection means 26 and 28 are positioned on roof 10 closely adjacent to the location of mast structure 14 to minimize hose length. Viewing the mast structure 14 as being located at a 6 o'clock position, the left-handed coolant connection means is located at a 7 to 8 o'clock position.

In the operation of a furnace system as above described, which requires continuous raising, swinging and lowering of the spray cooled roof, the relatively massive mast arm components extend past, and closely adjacent, the vertical opening in the furnace roof and thus are exposed to the intense heat from the furnace and the molten metal.

Figure 4:
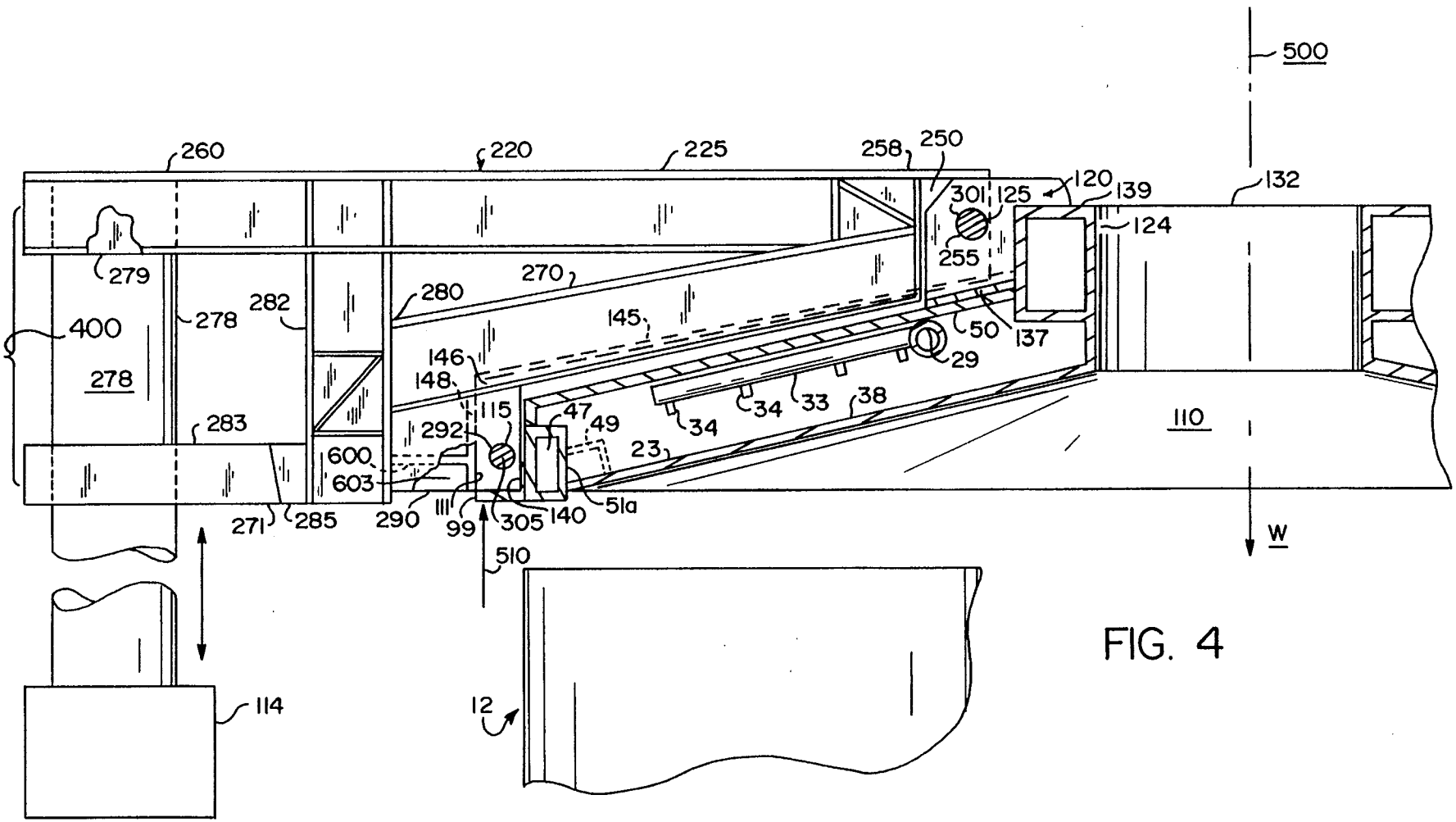
FIG. 4 is a side elevation view, partly in cross-section of the combination of the present invention.
Figure 5:
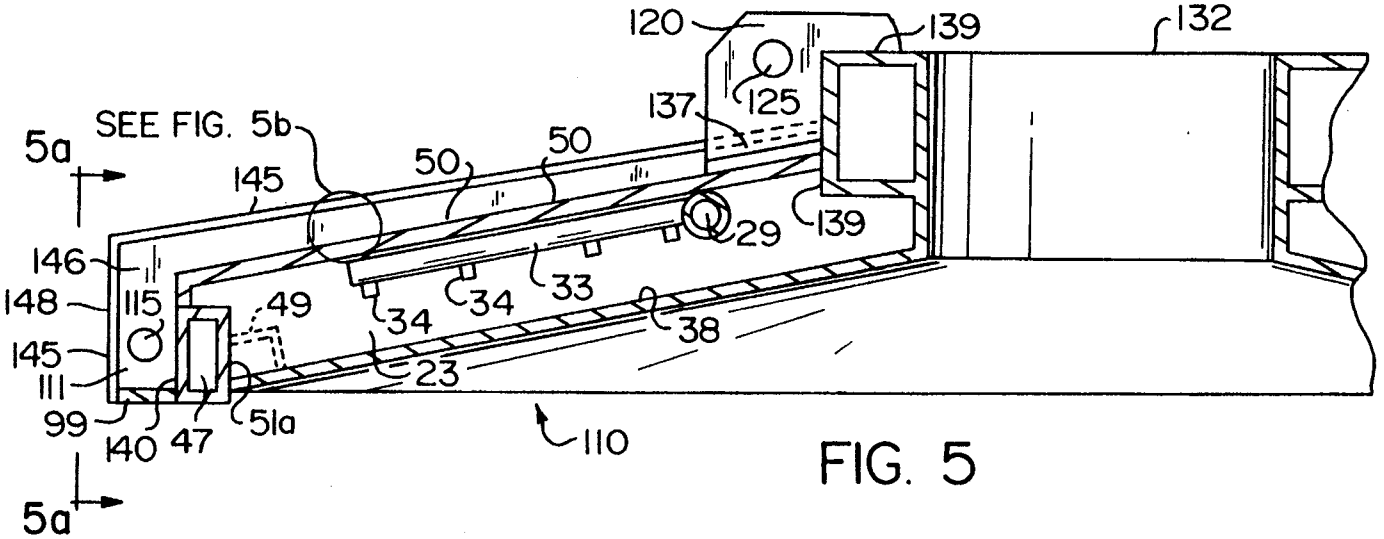
FIG. 5 is an elevation view, partly in cross-section of the roof member of the combination of the present invention.
Figure 5B:
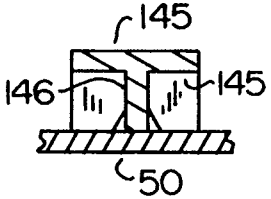
FIGS. 5*a* and 5*b* are side views of the roof member of FIG. 5.
Figure 5A:
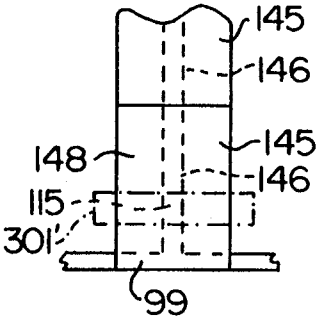
Figure 6:
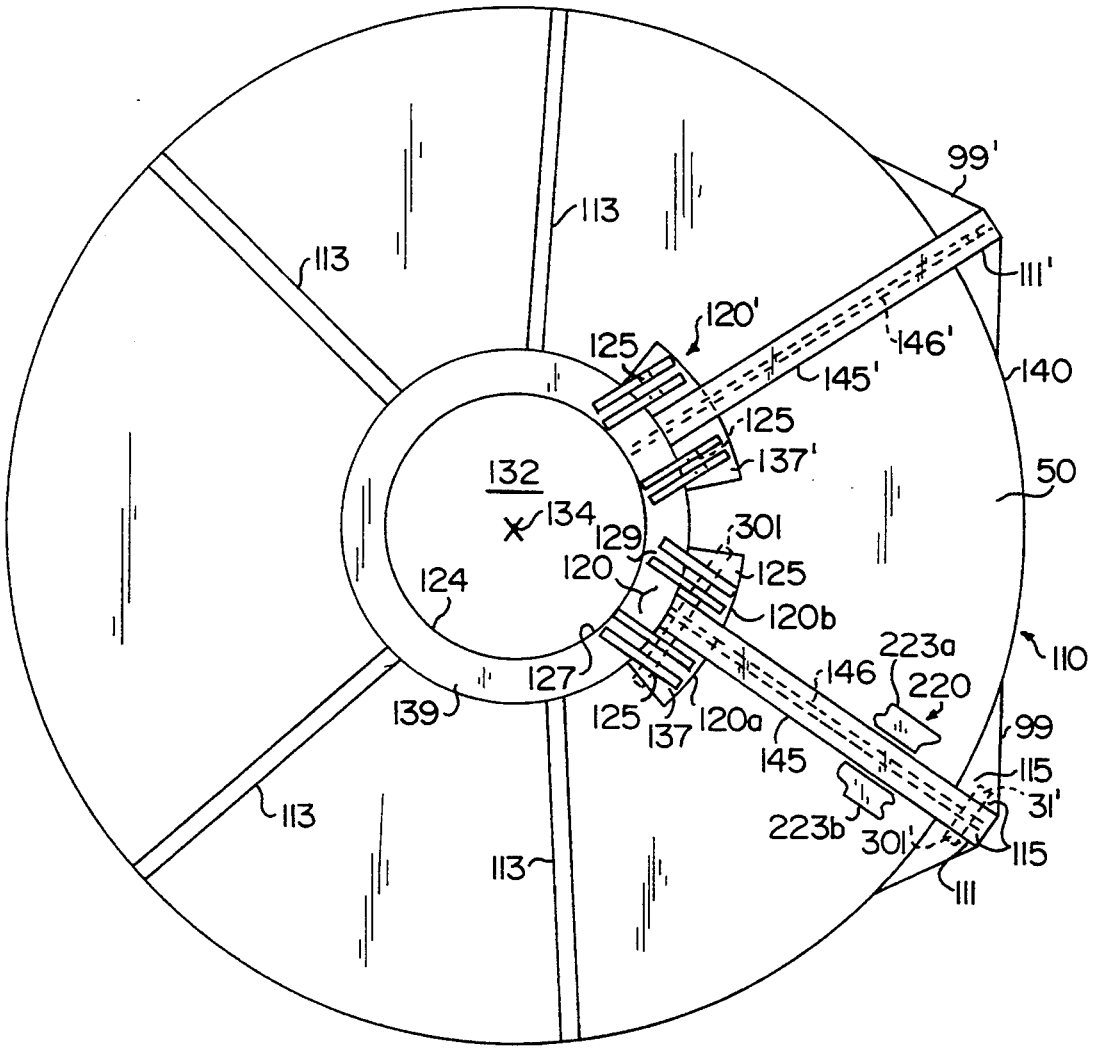
FIG. 6 is a top plan view of the roof member of the present invention.

In the present invention, with reference to FIGS. 4–9, spray cooled roof 110, shown in cross-section in FIG. 5 and in a top plan view in FIG. 6, is provided with a pair of engagement elements 111, 120 which have respective through apertures 115, 125. Engagement element 111 has a horizontally transverse integral ledge portion 99 which is affixed to the vertical side portion 140. Engagement element 120 is suitably a vertical steel plate, and, in a preferred embodiment, comprises two pairs, 127, 129 of apertured vertical steel plates 120*a*, 120*b* with apertures 125 in register, being affixed by welding to the upper roof surface 50 by way of base plate 137 and reinforcing box channel 139 which surrounds vertical central opening 132 in roof 110. Engagement element 120 with its aperture 125 is positioned closely adjacent to the periphery 124 of vertical opening 132. Engagement element 111 is suitably a terminal portion of the web 146 of a steel reinforcing rib 145 welded to roof 110. The engagement elements 111, 120 are spaced apart and are substantially in-line with the center 134 of the central opening 132 in roof 110. The engagement element 111 with aperture 115 is affixed outwardly adjacent the peripheral vertical side portion 140 of roof 110; engagement element 120 is affixed adjacent the vertical opening 132 and the apertures 125 are in register as shown in FIG. 6. A rib 145 in the form of a flanged steel beam, the web 146 of which is welded to roof 110 along its upper surface 50, its peripheral side portion 140 and at channel 139. Aperture 115 passes through web 146. The steel rib 145 strengthens the upper surface portion 50 of roof 110 for the lifting procedure hereinafter described. An additional set of engagement elements 111', 120' and a rib 145' can be provided to conveniently enable both left hand and right hand roof displacement as hereinafter described. Auxiliary radial, steel strengthening ribs 113 can also be provided and welded to the outer surface.

Figure 7:
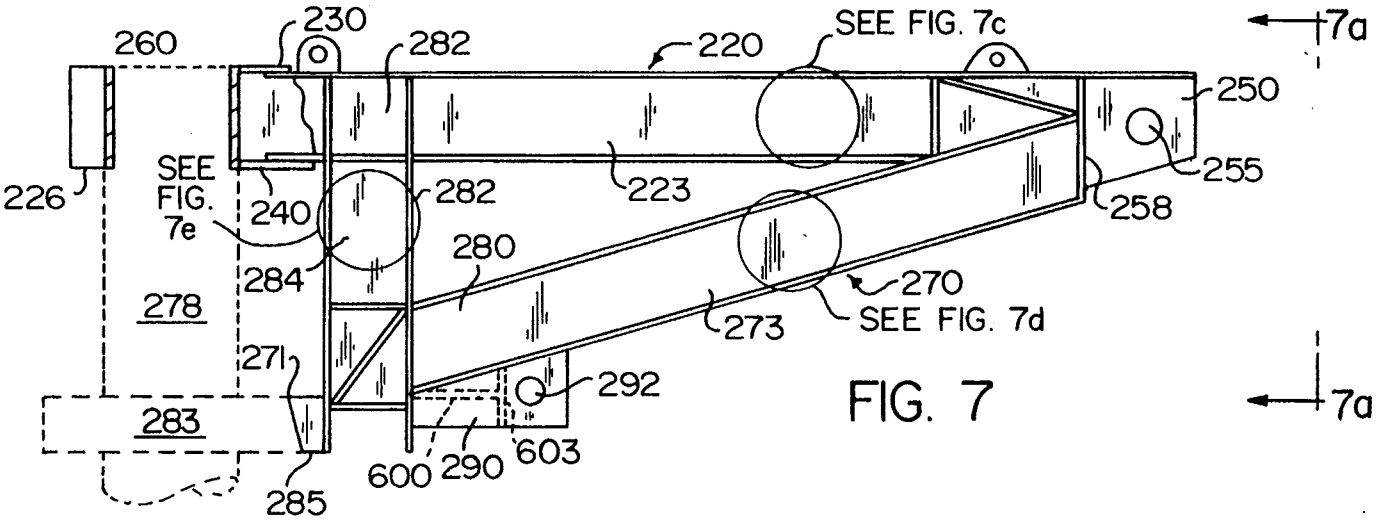
FIG. 7 and FIG. 7*a* are side elevation and front elevation views of the support arm of the combination of the present invention.
Figure 7B:
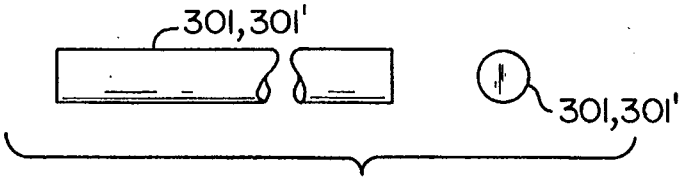
FIG. 7*b* shows a pin type engagement means of the present invention.
Figure 7A:
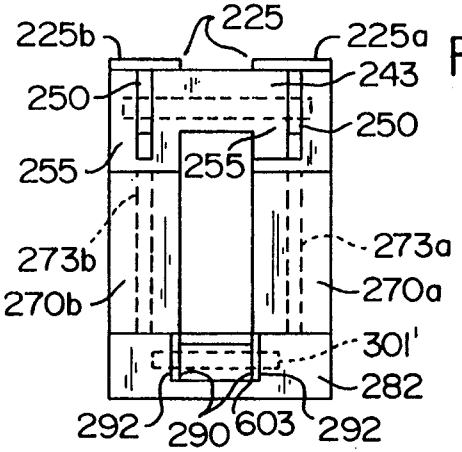
Figure 7C:
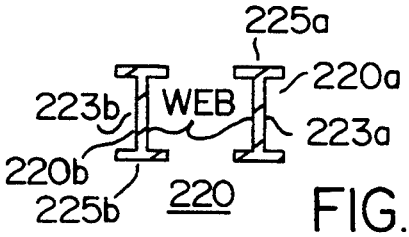
FIGS. 7*c*–7*e* are cross-section views of the reinforcing ribs of the support arms for the roof member of the present invention.
Figure 7D:
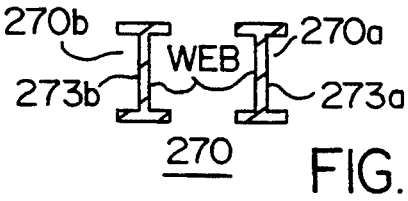
Figure 7E:
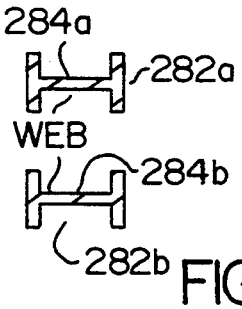
Figure 8:
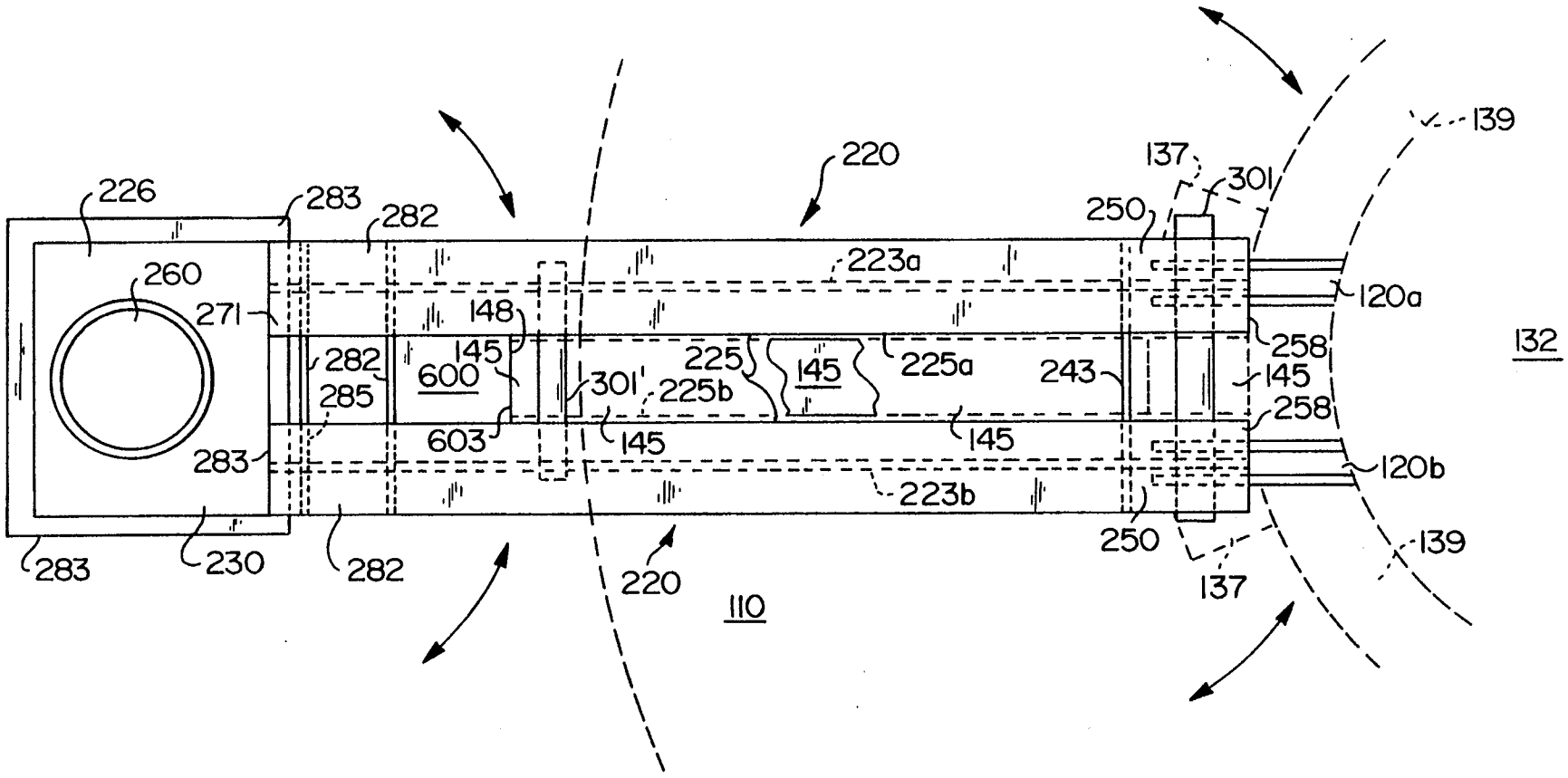
FIG. 8 is a top plan view of the support arm of FIG. 7.

The support member of the present invention is shown at 220 in FIG. 4 and is shown separately in the elevation view of FIG. 7 and the top plan view of FIG. 8. Support member 220 comprises a first horizontally extending element 225, shown as a pair of joined flanged steel beams 225*a*, 225*b* with flange webs 223*a*, 223*b*, joined by welding at plates 230, 240, 243 and extending only over a radial closed portion of roof 110 and terminating adjacent the vertical opening 132 of roof 110. Engagement means 250 of horizontally extending element 225 have apertures 255 and are affixed adjacent the end 258 of horizontally extending element 225. A vertically extending passage 260 is provided adjacent to opposite end 226 of horizontally extending element 225 for coupling to a mast 278 as hereinafter described. An obliquely extending element 270, also in the form of a pair of joined steel beams 270*a*, 270*b*, with flange webs 273*a*, 273*b*, is affixed to the horizontally extending member 225, e.g. by welding adjacent end 258, and extends downward toward mast post 278 and has an end position 280. A third vertical element 282 of the support arm 220 is affixed to the first horizontal member 225 and to the oblique member 270. An integral extension 285 of vertical member 282 bears against the shelf structure 283 of post 278 at 271. Engagement means 290 with through aperture 292 is affixed to vertical member 282.

In the present invention, with reference to FIG. 4, support arm 220 is coupled to vertical mast 278 at its vertical opening 260 and rests on inner ledge 279 of mast 278 and is further supported by abutment at 271 of the extension 285 of vertical element 282 with shelf 283 of mast 278. The mast driving structure 114 is a commercially available mechanism which raises, lowers and rotates mast 278 and the support arm 220 coupled thereto. The engagement means 250 of support arm 220 is closely adjacent roof engagement element 120 and the apertures 125 and 255 are in register and receive a snugly fitting removable pin 301. Also, the engagement means 290 of support arm 220 is closely adjacent roof engagement element 111 shown more clearly in FIG. 5 and the apertures 115 and 292 are in register and receive a snugly fitting removable pin 301'. With the roof 110, support arm 220 and mast 278 assembled as aforedescribed the roof 110 can be raised, lowered and swung horizontally.

In the present invention, with the roof 10 raised by support arm 220 the vertically downward force representing the weight of the roof 10 is applied at the cantilevered end 258 of horizontally extending element 225 and is resolved to apply a component of compressive force through obliquely extending element 270 which causes the extension 285 of vertical element 282 to bear inwardly against the integral shelf 283 of mast 278. With this arrangement the weight of the roof is supported mostly by horizontally extending element 225, which is in tension, and the supporting obliquely extending element 270, which is in compression a relatively minor tensile force is applied to vertical element 282. The vertical element 282 suitably comprising joined flanged steel beams 282*a*, 282*b* with flange webs 284*a*, 284*b*, serves to maintain the vertical coupling distance 400 between horizontal element 225 and oblique element 270 to enable the force distribution above-described. A satisfactory coupling distance is 25% to 65% of the length of oblique element 270 which corresponds to the typical slope of 5° to 25° for typical frusto-conical spray cooled roofs.

The position of the center of gravity 500 of roof 10 results in application of an upwardly directed force 510 at the ledge portion 99 integral with roof 100 due to the movement about pin 301 of the force due to the weight (W) of roof 10 acting at the center of gravity 500. The vertical face 148 of reinforcing rib 145 is in close contact with the vertical face 603 of brace member 600 which is integral with engagement means 290 and vertical element 282. The upwardly directed force 510 causes the vertical face 148 of reinforcing rib 145 to bear against the vertical face of brace member 600 at engagement means 290. This bearing force is applied thusly due to the rotational moment acting on roof 10 about pin 125 resulting in force 510. The vertical faces 148 and 603 are in close contact when the roof 10 is at rest and bear forcefully against each other upon lifting of roof 10. Thus, pin 301' is therefore not essential to the lifting of roof 10. However, since molten material can solidify at the underside of roof 10 and offset the upward force 510, pin 301' is available if needed to engage the roof 10 to the support arm 220. Particular advantages of the present invention are the relatively small mass of the support member component and its position completely shielded by the water cooled roof from the heat of the furnace and molten metal. Also since the lifting arm is removable from the roof, a single lift arm can be used for connecting to an original equipment roof or to a spare roof. Thus, two or more roofs procured for one specific furnace require only one lift arm. This results in economic and storage savings as compared to roofs that contain integral non-removable lift arm devices, which must be purchased as a part of a roof. Additionally, for steel mill users who have both left-hand and right-hand furnaces, one or more roofs are common to either furnace. This results in a cost savings as compared to the requirement of maintaining right-hand roofs for a right-hand furnace and left-hand roofs for a left-hand furnace. Each furnace requires one lift arm if the arm is removable from a roof. A typical example would be a steel mill user who has both right-hand and left-hand furnaces and desires to have a spare roof for each furnace. With the present invention, only 2 lift devices and 3 roofs are required to provide a spare roof. Whereas for roofs that each contain an integral, nonremovable lift device 4 roofs, containing 4 integral lift arms, are necessary in order to provide a spare roof for each furnace. This is much more costly. A spare roof for each furnace is satisfied if there is one spare roof that can fit either furnace, a total of 2 spare roofs for 2 furnaces is only required when the roofs are not interchangeable between furnaces. Steel mills cycle their furnace maintenance schedules so that periodic replacement of one roof occurs over a staggered time period such as every six months. This provides opportunity to perform off-the-furnace maintenance on one roof every six months or so and have that roof ready as a spare for the next scheduled roof replacement. Roof replacements can thus alternate between each furnace.

The aforementioned roof and support members are suitably made from plain carbon steel components which are conventionally welded together to form the respective unitary roof and support structures. In an alternate embodiment, the support member can be formed as a structural box by welding together suitable shapes of suitably reinforced steel plates. Also, releasable clamps can be used in place of the steel pin connectors.

What is claimed is:

1. A furnace roof lifting and moving device comprising, in combination, a) a horizontally disposed, removable, substantially hollow, internally spray cooled roof member of an electric furnace formed from welded-together steel plate into a sloped, unitary frusto-conical structure, said roof member having (i) a peripheral side portion, (ii) a centrally located vertical opening spaced inwardly from said peripheral side portion for passage therethrough of furnace electrodes, (iii) first roof engagement means affixed to the exterior of said roof member closely adjacent said peripheral side portion, (iv) second roof engagement means affixed to the exterior of said roof member closely adjacent said vertical opening of said roof member, said first and second engagement means being spaced apart and being substantially in-line with said vertical opening;

(b) vertical mast post means for raising and lowering the roof member and being rotatable to laterally displace the roof member when engaged thereto;

(c) a support member cooperatively engaged with said vertical mast post means to be raised, lowered and rotated thereby and being in detachable engagement with said roof member, said support member having (i) a first element extending horizontally from said vertical mast post means above said roof member and above said first roof engagement means of said roof member to a first element end position above said second roof engagement means of said roof member, said horizontally extending first element being supportably engaged with said vertical mast post means to be raised, lowered and rotated thereby, (ii) a second element affixed to said first element adjacent said first element end position of said first element and extending obliquely downward directly below said first element toward said vertical mast post means to a second element end position intermediate the peripheral side portion of the roof member and the vertical mast post means, (iii) a third element affixed to said first element and said second element and extending vertically between the second element end position and said first element, (iv) first support member engagement means affixed to said support member to be closely adjacent the first roof engagement means, (v) second support member engagement means affixed to said support member to be closely adjacent the second roof engagement means;

(d) a releasable connector element for securing together the second roof engagement means with the second support member engagement means; said support member being in bearing contact with the vertical mast post means at a location oppositely adjacent the end position intermediate said peripheral side portion of said roof member and said vertical mast post means.

2. Combination in accordance with claim 1 wherein an additional separate releasable connector element is provided for securing together the first roof engagement means with said first support member engagement means.

3. Combination in accordance with claim 1 wherein said spray cooled roof member has an integral raised ring member surrounding and adjacent said vertical opening.

4. Combination in accordance with claim 3 wherein said roof member is provided with a first raised rib affixed to the roof member which extends from a terminal portion thereof adjacent the ring member to the peripheral side portion of the roof member and is affixed to and has a portion extending outwardly from said side portion.

5. Combination in accordance with claim 4 wherein a horizontally extending shelf member is affixed to said side portion below the outwardly extending portion of said rib and is affixed thereto.

6. Combination in accordance with claim 5 wherein an aperture is provided in said extending portion of said rib to receive a releasable connector element in the form of a pin for securing together the first roof engagement means with said first support member engagement means.

7. Combination in accordance with claim 5 wherein an aperture is provided in said extending portion of said rib to receive a releasable connector element in the form of a pin for securing together the second roof engagement means with the second support member engagement means.

8. Combination in accordance with claim 4 wherein the roof member is provided with an additional raised rib essentially the same as the first raised rib which is spaced away from said first raised rib.

9. Combination in accordance with claim 1 wherein the slope of the frusto-conical structure of said roof member is between about 5 and 25 degrees.

10. Combination in accordance with claim 9 wherein said second element is substantially parallel to the slope.

11. Combination in accordance with claim 4 wherein said second element is formed of two spaced apart parallel members which laterally enclose the first raised rib member in the space therebetween.

* * * * *